US006966260B1

(12) United States Patent
Martinez

(10) Patent No.: US 6,966,260 B1
(45) Date of Patent: Nov. 22, 2005

(54) CLIP-ON DEVICE FOR COUPLING AN ELECTRIC MATCH TO A PYROTECHNIC FUSE

(76) Inventor: Phillip M. Martinez, 205 Bossard Rd., Groton, NY (US) 13073

( * ) Notice: Subject to any disclaimer, the term of this patent is extended or adjusted under 35 U.S.C. 154(b) by 69 days.

(21) Appl. No.: 10/778,451

(22) Filed: Feb. 13, 2004

(51) Int. Cl.[7] ..... C06C 5/06
(52) U.S. Cl. ..... 102/202.11; 102/202.9; 102/275.7; 102/275.12
(58) Field of Search ..... 102/275.12, 275.4, 102/275.7, 202.9, 202.11, 202.12, 202.14

(56) References Cited

U.S. PATENT DOCUMENTS

| | | | | |
|---|---|---|---|---|
| 4,730,560 | A * | 3/1988 | Bartholomew et al. | 102/275.3 |
| 4,771,694 | A * | 9/1988 | Bartholomew et al. | 102/275.7 |
| 4,998,478 | A * | 3/1991 | Beck | 102/275.7 |
| 5,070,789 | A * | 12/1991 | True et al. | 102/275.12 |
| 6,311,621 | B1 * | 11/2001 | Marshall et al. | 102/202.5 |
| 6,874,424 | B2 | 4/2005 | Bailey et al. | |

FOREIGN PATENT DOCUMENTS

| | | | |
|---|---|---|---|
| EP | 0 500 512 A2 | * | 8/1992 |
| GB | 2 109 512 A | * | 6/1983 |

* cited by examiner

*Primary Examiner*—Stephen M. Johnson
(74) *Attorney, Agent, or Firm*—Mark Levy & Associates, PLLC; David L. Banner

(57) ABSTRACT

There is provided a molded polymeric coupling device incorporating integral hinges, latches and strain-relief features adapted to receive an electric match having a protective chamber, and a quickmatch fuse of a pyrotechnic device. After the quickmatch fuse is suitably placed in the coupling device, it is latched in a closed position around the quickmatch fuse. A piercing structure such as a cone forms an opening in the outer layer of the quickmatch fuse so that, upon ignition of the electric match, flame therefrom is directed into and ignites the central blackmatch core of the quickmatch fuse. The coupling device allows rapid and accurate attachment of an electric match to a quickmatch fuse at the fireworks display site by persons of limited skill and/or experience. The electric matches are protected by the coupling device, preventing unexpected ignition from impact, friction, ESD, or other similar ignition sources.

16 Claims, 3 Drawing Sheets

CLIP-ON DEVICE FOR COUPLING AN ELECTRIC MATCH TO A PYROTECHNIC FUSE

FIELD OF THE INVENTION

The present invention pertains to the field of electrically igniting pyrotechnic devices and, in particular, to a simple, clip-on coupler for attaching an electric match to the leader or fuse of a pyrotechnic device such as a firework.

BACKGROUND OF THE INVENTION

At the present time, electrical initiation of pyrotechnics, particularly those such as fireworks for the entertainment industry, is accomplished through the use of pyrotechnic igniters known as electric matches and sometimes referred to as electric igniters. The use of electric matches in a fireworks display allows the operator to initiate (i.e., ignite or fire) the pyrotechnics from a safe distance, and also affords the opportunity to synchronize the firing of pyrotechnics to a musical score through the use of automated, computer-generated firing commands.

Typically, these electric matches utilize a high resistance wire, most often Nichrome wire, which is attached by various means to the ends of two insulated copper conductor lead wires. The resistance wire is coated with a temperature sensitive pyrotechnic composition. When an electrical current is applied to the copper lead wires, the resistance wire (also known as a bridgewire), heats up to the ignition temperature of the pyrotechnic composition, thereby creating a flame.

Hot sparks and molten slag from the combustion byproducts are projected outward, which, in turn, ignites another pyrotechnic device such as a display firework shell. Electric matches on the market today have serious safety issues, fatal accidents having occurred through their improper handling. These safety issues arise from the pyrotechnic mixtures utilized in electric match construction, the mixtures typically being sensitive to impact, friction, electrostatic discharge (ESD), stray electric currents, ground currents, and radio-frequency (RF) energy. It is common practice for manufacturers of electric matches to provide a plastic or rubber covering, known as a shroud, over the bulb of the pyrotechnic composition on the electric match to protect it from damage and accidental application of ignition stimuli.

Professional display fireworks typically utilize a quickmatch fuse, which comprises a thin paper tube of approximately three turns of paper covering an inner ignition core known as blackmatch. The blackmatch typically consists of several strands of cotton string which has been coated heavily with black powder in a suitable binder. In order to prepare the firework device for the attachment of an electric match, a technician typically makes an incision through the layers of paper on the quickmatch, thereby accessing the blackmatch core. The technician must then insert the electric match, with the protective shroud in place, into the quickmatch tubing adjacent to the blackmatch core. The incision is then covered with a length of masking tape. The lead wires from the electric match are folded over this piece of tape. Additional tape is then wrapped around the quickmatch, the lead wires folded over again, and then still more tape is wrapped over the folded lead wire and quickmatch tube, thereby securing the electric match within the quickmatch. This process forms a strain-relief for the electric match so that it is anchored to the quickmatch.

The previously described method is one of several methods commonly used for preparing the quickmatch for the electric match. All such techniques require a certain amount of skill on the part of the technician in order to successfully couple the quickmatch with the electric match. Several problems are known to occur when these techniques are practiced by unskilled technicians. For example, failure to function (i.e., the electric match does not ignite the blackmatch core of the quickmatch) will likely occur if the technician inserts the electric match between the folds of paper on the quickmatch such that the black powder core is not directly contacted. Another potential problem occurs when a quickmatch has a smaller than expected diameter. When this happens, the technician invariably removes the protective shroud on the electric match in order to insert it into the quickmatch tube, thus defeating the safety purposes for the shroud. This shroud removal substantially increases the risk of an accidental impact ignition of the electric match if firework shells happen to collide at this particular spot on the quickmatch, during shipping or handling, or if the firework shell is dropped on a hard surface.

Because of the technical skill needed as well as the amount of time required to correctly prepare the firework devices, attaching electric matches to leaders or fuses is typically performed at the fireworks plant. The electric match equipped devices are then stored at the plant until they are needed at a particular show location. While it is certainly safer to prepare the fireworks devices at the show location, this is typically not done due to the constraint of time and the need for experienced personnel to perform the work.

One attempt to solve the aforementioned problems is provided in U.S. Pat. No. 4,825,764 for CONNECTING DEVICE BETWEEN A FIRING FUSE OF A PYROTECHNIC PRODUCT AND AN IGNITER, issued May 2, 1989 to Marie-Jacques Jullien. The JULLIEN apparatus is designed to couple an electric igniter to the end of a fuse such as a quickmatch fuse. Proper assembly still requires preparation of the end of the quickmatch fuse and there is a high potential for misfiring of the pyrotechnic when the JULLIEN apparatus is used by an unskilled operator.

The present invention overcomes the shortcomings of these prior art procedures by providing an electric match/fuse coupling device designed to reduce or eliminate the foregoing safety issues and at the same time provide a method for quickly attaching an electric match to a quickmatch fuse by personnel of limited skill.

SUMMARY OF THE INVENTION

In accordance with the present invention, there is provided a molded polymeric coupling device incorporating integral hinges, latches and strain-relief features. The inventive coupling device allows rapid and accurate attachment of an electric match to a quickmatch fuse at the site of the fireworks display. The coupling device of the invention may be used by persons of limited skill and/or experience to assemble electric matches to fireworks shells or other display items. The electric matches are protected by the coupling device so as to prevent unexpected ignition from impact, friction, ESD, or other sources of perturbation.

It is therefore an object of the invention to provide an electric match attachment device that eliminates the need for manual preparation of the quickmatch fuse tube by slitting or cutting.

It is another object of the invention to provide an electric match attachment device which may be satisfactorily used by personnel having limited training or skill.

It is a further object of the invention to provide an electric match attachment device that is quick and easy to use.

It is a still further object of the invention to provide an electric match attachment device that requires neither tools nor supplies such as tape, string, or cable ties for installation.

It is a still further object of the invention to provide an electric match attachment device which is relatively impervious to various natural weather conditions, such as dampness, that give rise to unreliability.

It is an additional object of the invention to provide an electric match attachment device which retains the electric match in a protective chamber, thereby protecting the electric match from impact, friction, static electricity, and the like.

It is yet another object of the invention to provide an electric match attachment device which is inexpensive.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The present invention provides a clip-on, self-centering attachment device for connecting an electric match to a fuse, typically a quickmatch, of a pyrotechnic device such as a firework shell or similar firework display item.

Figure 1:
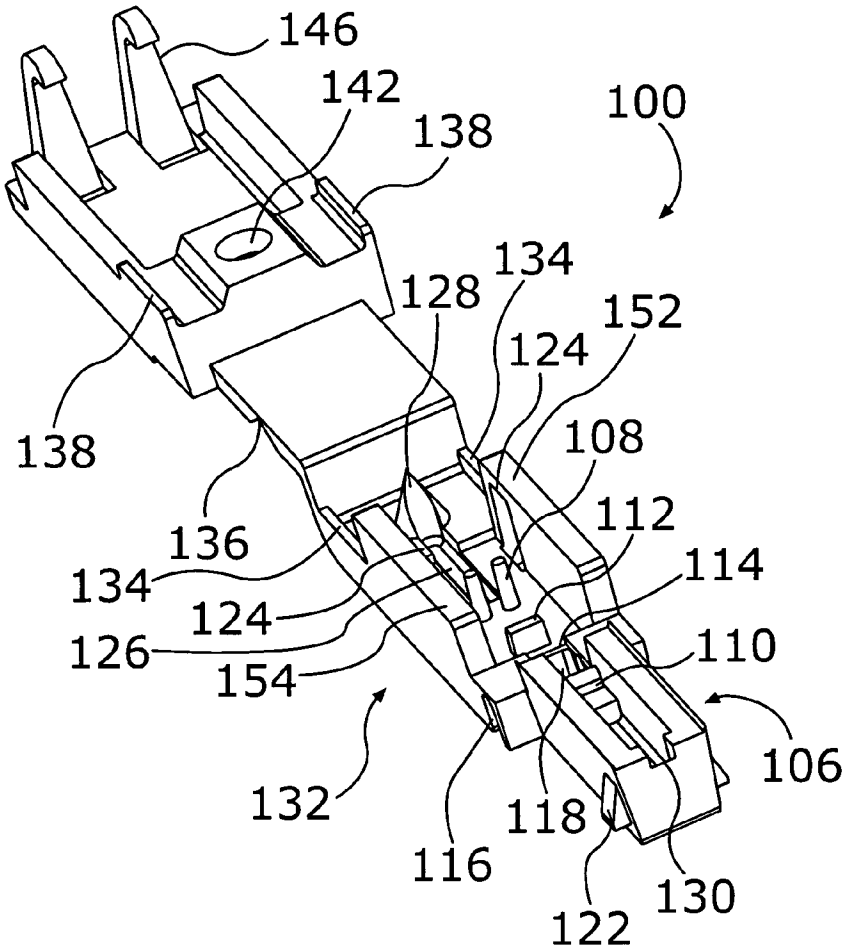
FIG. 1 is a perspective view of the attachment device of the invention in an open position.
Figure 2:
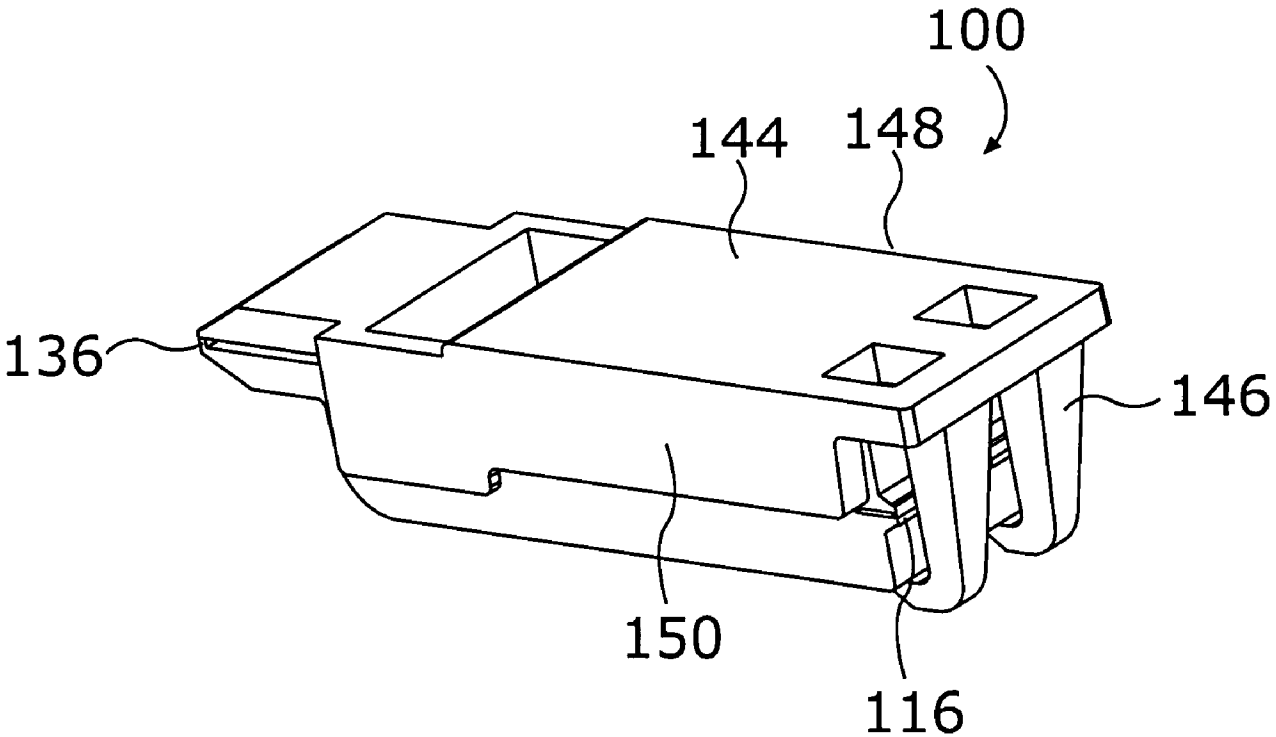
FIG. 2 is a perspective view of the attachment device of the invention in a closed and latched position.
Figure 3:
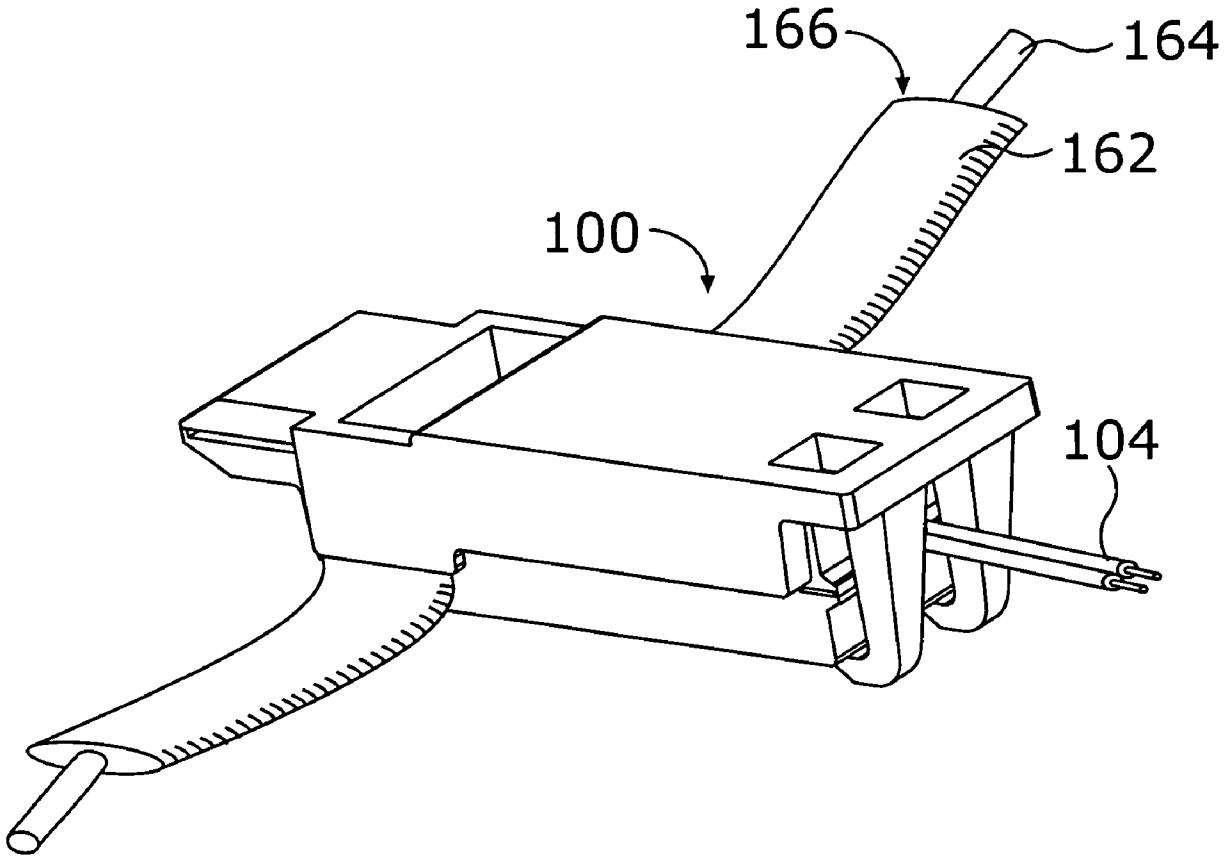
FIG. 3 is a perspective view of the attachment device is its intended operating environment.

Referring to FIGS. 1, 2, and 3 there are shown a perspective view of the attachment device of the invention in a closed and latched position, a perspective view of the attachment device of the invention in an open position, and a perspective view of the attachment device is its intended operating environment, generally at reference number 100. Attachment device 100 is typically molded from a polymeric resin such as polypropylene or high-density polyethylene. It will be recognized that other polymers could also be used and the invention is not considered limited to polypropylene but is seen to encompass any other suitable material. An electric match, not shown, having lead wires 104 attached thereto is housed within a cover 106 and is held in proper position by two guide posts 108 and a locating block 112 in a main housing 132. Locating block 112 and a support surface 114 along with a rib 110 in cover 106 form a strain-relief feature for electric match lead wires 104, thereby preventing movement of the electric match if a tensile load, not shown, is applied to lead wires 104.

Main housing 132 and cover 106 are connected to one another by an integral hinge 116 co-molded from the same plastic resin as used to mold the remainder of attachment device 100. This type of design element is also referred to as a "living hinge". An opening 118 is provided in main housing cover 132 to provide clearance for electric match leads 104.

After the electric match is positioned in main housing 132, cover 106 is pivoted about hinge 116 to enclose the electric match. Cover 106 is held in a closed position by two locking latch elements 122 that are molded into cover 106 and which interact with mating latch elements 124 that are molded into main housing 132. The electric match is thus encased in plastic and protected from damage which might result in an unintended ignition due to impact, friction or electro-static discharge. It will be recognized that the electric match with leads 104, while shown to demonstrate the function of attachment device 100, form no part of the present invention.

In operation, the attachment device 100 of the invention is typically used in the following manner. A quickmatch fuse 162 attached to a pyrotechnic device, not shown, is positioned on top of a piercing cone 128 which is integrally molded as part of main housing 132. While a conical shape has been chosen for purposes of disclosure, it will be recognized that a projection of any suitable shape, for example, a pyramid may be used to pierce the paper jacket of a quickmatch fuse 162. Consequently, the invention is not considered limited to the conical structure chosen for purposes of disclosure but is seen to encompass any other suitable shapes. A clamping plate 144 is also co-molded with main housing 132 and joined thereto by hinge 136.

After the quickmatch fuse 166 is properly positioned, clamping plate 144 is rotated about hinge point 136 so that two locking fingers 146 engage mating locking surfaces on main housing 132 as may readily be seen in FIG. 3. Closing clamping plate 144 and locking it to main housing 132 causes the quickmatch fuse 166 covering 162 to become pierced by movement of piercing cone 128 into a hole 142 disposed in clamping plate 144. The covering 162 of quickmatch fuse 166, is generally paper, but may also be thin plastic. Regardless of the material, piercing cone 128 readily pierces the material.

Two ridges 134 on main housing 132 as well as two additional ridges 138 on clamping plate 144 restrain movement of the quickmatch fuse 162. Reinforcing walls 148, 150 are provided in clamping plate 144 to increase its section modulus, thereby reducing the bending deflection thereof under load. In like manner, reinforcing walls 152, 154 are provided in cover 132. The heights of these reinforcing walls 148, 150, 152, 154 are designed to help prevent failure of the attachment device 100 under extreme clamping load conditions. Variations in the clamping load are influenced by differences in the thickness of the quickmatch from manufacturer to manufacturer.

In operation, when attachment device 100 is in an open position as shown in FIG. 1, the quickmatch fuse 166 of a pyrotechnic device, not shown, is laid between main housing ridges 134. An electric match is inserted into opening 118. It is anticipated that the attachment device 100 of the invention could be supplied with an electric match preassembled, probably by an electric match manufacturer.

Once both the electric match and quickmatch 166 are properly positioned, attachment device 100 is closed and latched. As attachment device 100 is closed, piercing cone 128 pierces cover 162 of quickmatch 166. When an electric current is applied to the wire leads 104 of the electric match, the pyrotechnic mixture on the electric match inflames. The flame front is directed by angled opening 130 on cover 106 into a flame channel 126, that is molded into main housing 132 and into the side of piercing cone 128. This effectively directs the flame from the electric match into the quickmatch fuse 166, reliably igniting the blackmatch core 164 thereof. The ignited core 164 of the quickmatch 166 travels to the intended pyrotechnic device which is consequently ignited.

The inventive apparatus solves all of the problems of the prior art. It allows inexperienced personnel to reliably and safely connect electric matches to the quickmatch fuses of pyrotechnic devices without any need for tools or supplies such as tape, string, cable ties, etc. The connections that result are much more reliable than has heretofore been possible and the speed with which electric matches may be attached to the quickmatch fuses is significantly greater than that of any prior art method.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed:

1. An apparatus for coupling an electric match to a quickmatch fuse having an inner core of a pyrotechnic device, comprising:

a) a hinged structure comprising a cover portion and a clamping plate, said hinged structure being movable between an open position and a closed position;

b) means for latching said hinged structure in said closed position;

c) a first channel disposed in said cover portion of said hinged structure and having openings at both proximal and distal ends thereof, said opening at said proximal end being adapted to receive said electric match inserted thereinto, and said electric match being retained in a predetermined position within said first channel after insertion;

d) means for positioning said quickmatch fuse proximate said first channel and for retaining said quickmatch fuse when said hinged structure is in said closed position;

e) means for piercing the exterior covering of said quickmatch fuse, thereby producing an opening to the inner core thereof; and f) a second channel, communicative with both said opening at said distal end of said first channel and with said opening to said inner core of said quickmatch;

whereby, upon ignition of said electric match, a flame therefrom is directed to said opening to said inner core by at least said second channel, resulting in ignition of said inner core by said flame.

2. The apparatus for coupling an electric match to a quickmatch fuse of a pyrotechnic device, as recited in claim 1, wherein said pyrotechnic device comprises a fireworks display shell.

3. The apparatus for coupling an electric match to a quickmatch fuse of a pyrotechnic device, as recited in claim 1, wherein said coupling apparatus comprises a one-piece thermoplastic structure molded from a thermoplastic resin.

4. The apparatus for coupling an electric match to a quickmatch fuse of a pyrotechnic device, as recited in claim 3, wherein said thermoplastic resin comprises one of the resins: polypropylene, and polyethylene.

5. The apparatus for coupling an electric match to a quickmatch fuse of a pyrotechnic device, as recited in claim 1, wherein said hinged structure comprises at least one integral hinge disposed between said cover portion and said clamping plate.

6. The apparatus for coupling an electric match to a quickmatch fuse of a pyrotechnic device, as recited in claim 1, wherein said means for piercing comprises at least one of the shapes: a cone, and a pyramid, disposed on said cover portion.

7. The apparatus for coupling an electric match to a quickmatch fuse of a pyrotechnic device, as recited in claim 1, wherein said hinged structure is manually movable from said open position to said closed position and said latching means is operable manually.

8. The apparatus for coupling an electric match to a quickmatch fuse of a pyrotechnic device, as recited in claim 7, wherein said apparatus for coupling retains said electric match and said quickmatch securely within said apparatus when said hinged portion is latched in said closed position.

9. The apparatus for coupling an electric match to a quickmatch fuse of a pyrotechnic device, as recited in claim 1, wherein said means for latching comprises at least one locking latch.

10. The apparatus for coupling an electric match to a quickmatch fuse of a pyrotechnic device, as recited in claim 1, wherein said first chamber comprises a locating surface to facilitate retaining said electric match at a predetermined position therein.

11. The apparatus for coupling an electric match to a quickmatch fuse of a pyrotechnic device, as recited in claim 10, wherein said first channel functions as a protective chamber for said electric match retained at said predetermined position therein.

12. The apparatus for coupling an electric match to a quickmatch fuse of a pyrotechnic device, as recited in claim 10, wherein said first channel further comprises a strain-relief structure for retaining an external lead wire attached to said electric match.

13. The apparatus for coupling an electric match to a quickmatch fuse of a pyrotechnic device, as recited in claim 1, wherein said means for positioning and retaining said quickmatch fuse comprises at least one ridge adapted to grip said quickmatch when said hinged structure is latched in said closed position.

14. A method for coupling an electric match to a quickmatch fuse having an inner core of a pyrotechnic device, the steps comprising:

a) providing an apparatus for coupling said electric match to said quickmatch fuse, comprising:

a hinged structure comprising a cover portion and a clamping plate, said hinged structure being movable between an open position and a closed position;

means for latching said hinged structure in said second, closed position;

a first channel disposed in said cover portion of said hinged structure and having openings at both proximal and distal ends thereof, said opening at said proximal end being adapted to receive said electric match inserted thereinto, said electric match being retained in a predetermined position within said first channel after insertion;

means for positioning said quickmatch fuse proximate said first channel and for retaining said quickmatch fuse when said hinged structure is in said closed position;

means for piercing an exterior covering of said quickmatch fuse and producing a opening to the inner core thereof; and a second channel, communicative with both said distal end of said first channel and with said opening in said exterior covering of said quickmatch;

b) placing said quickmatch fuse of a pyrotechnic device into said hinged structure; and c) moving said hinged structure from said first, open position to said second, closed position and latching said hinged structure in said second, closed position.

15. The method for coupling an electric match to a quickmatch fuse of a pyrotechnic device, as recited in claim 14, the steps further comprising:

d) applying a predetermined electric current to leads of said electric match;

whereby said electric match is ignited, flame from the ignition of said electric match is conveyed via said second channel to said inner core of said quickmatch fuse, and said pyrotechnic device is ignited thereby.

16. The method for coupling an electric match to a quickmatch fuse of a pyrotechnic device, as recited in claim 14, the steps further comprising:

d) if said apparatus for coupling has not previously had said electric match installed therein, prior to said placing step (b), with said hinged structure in said open position, inserting an electric match into said opening at said proximal end of said first channel.

* * * * *